US005385181A

United States Patent [19]

Bhagwat et al.

[11] Patent Number: 5,385,181

[45] Date of Patent: Jan. 31, 1995

[54] DISPENSING CARTRIDGE

[75] Inventors: Anil Bhagwat, Hemel Hempstead; Alan Howard, Westoning, both of England

[73] Assignee: Xerox Corporation, Stamford, Conn.

[21] Appl. No.: 82,709

[22] Filed: Jun. 28, 1993

[30] Foreign Application Priority Data

Jul. 17, 1992 [GB] United Kingdom ..... 9215263

[51] Int. Cl.[6] ..... G03G 15/00

[52] U.S. Cl. ..... 141/364; 141/366; 141/375; 355/260; 222/171; 222/325; 222/DIG. 1

[58] Field of Search ..... 141/363–366, 141/346, 375, 383, 386; 355/245, 260; 222/171, 325, DIG. 1; 206/328, 334, 527; 220/253, 410

[56] References Cited

U.S. PATENT DOCUMENTS

| | | | |
|---|---|---|---|
| 4,060,105 | 11/1977 | Feldeison et al. | 141/363 X |
| 4,089,601 | 5/1978 | Navone | 222/171 X |
| 4,625,895 | 12/1986 | Tsukano | 355/260 X |
| 5,078,303 | 1/1992 | Kikuchi et al. | 222/325 X |
| 5,118,013 | 6/1992 | Mutou et al. | 222/171 |
| 5,235,389 | 8/1993 | Kikuchi et al. | 355/260 |
| 5,261,568 | 11/1993 | Corby et al. | 141/364 X |

*Primary Examiner*—J. Casimer Jacyna
*Attorney, Agent, or Firm*—John S. Wagley

[57] ABSTRACT

The invention relates to a dispensing cartridge adapted to discharge material therefrom to a receiving member during a dispensing operation. The cartridge includes an inner tubular member with an inner port therein. The cartridge also includes an outer tubular member with an inner surface, an outer surface, and an outer port therein. The inner tubular member is mounted rotatably within the outer member and is in sliding contact therewith. A cover is coupled to the inner tubular member and is adapted to rotate the inner tubular member in response to movement of the cover from a first position, wherein the inner port and the outer port are aligned with one another to define an exit aperture for discharging material from the cartridge to the receiving member, to a second position, wherein the inner port and the outer port are misaligned from one another to define a closed position preventing discharge of material from the cartridge. The cartridge further includes a receiver for receiving material contained in the cartridge during a dispensing operation and a housing having inner and outer tubular members. The inner member is concentrically mounted to and is in sliding contact within the outer member for either clockwise or anti-clockwise rotation therewith. Each member has a port. The ports are arranged to align with one another when the inner member is rotated in a first direction. The ports further are arranged to misalign with one another when the inner member is rotated in an opposed direction, to define a closed off position desirable prior to removal of the cartridge from the receiver.

6 Claims, 7 Drawing Sheets

DISPENSING CARTRIDGE

The present invention relates to a dispensing cartridge which is particularly, although not exclusively, useful as a toner dispensing cartridge for an electrophotographic copying machine. The cartridge is of the kind comprising a housing having an exit aperture for allowing material to be dispensed into a receiver during a dispensing operation.

During the operation of a typical electrophotographic copying machine, particulate toner material is consumed as each electrostatic latent image is developed with toner, and the developed image transferred to a copy sheet. Toner thus consumed is replenished, either by adding new toner to a toner hopper or reservoir which is built into the machine, or by exchanging an empty cartridge, which is in the form of a removable hopper, for a full one. The cartridge may equally easily be used either to load particulate material into a hopper, or to provide a hopper which remains in place on a machine until it is empty. The cartridges have different shaped housings but they all have exit apertures and commonly the apertures are of substantially oblong shape. One such known cartridge has a tubular housing for holding the toner, the housing having an oblong exit aperture. After filling the housing with toner the exit aperture is covered over with a sealant adhesive strip to prevent the escape of toner during transit of the cartridge. One of the disadvantages of such a cartridge is that the adhesive strip has to be removed prior to use of the cartridge, care being required in the removal, handling and disposal of the strip as the surface of the strip overlapping the aperture is often caked in toner. A further disadvantage is that the cartridge has to be carefully introduced into the machine in a horizontal direction by an operator if spillage of toner is to be avoided. A yet further disadvantage is that during use the outer surface of the cartridge may become caked in the toner so that upon its eventual removal an operator may find it difficult to avoid at least some toner dropping onto the floor and/or coming into contact with their hands and clothing.

SUMMARY OF THE INVENTION

In accordance with one aspect of the invention, there is provided a dispensing cartridge adapted to discharge material therefrom to a receiving member during a dispensing operation. The cartridge includes an inner tubular member with an inner surface, an outer surface, and an inner port therein. The cartridge also includes an outer tubular member with an inner surface, an outer surface, and an outer port therein. The inner tubular member is mounted rotatably within the outer member and is in sliding contact therewith. A cover is coupled to the inner tubular member and is adapted to rotate the inner tubular member in response to movement of the cover from a first position, wherein the inner port and the outer port are aligned with one another to define an exit aperture for discharging material from the cartridge to the receiving member, to a second position, wherein the inner port and the outer port are misaligned from one another to define a closed position preventing discharge of material from the cartridge. The cartridge further includes a receiver for receiving material contained in the cartridge during a dispensing operation and a housing having inner and outer tubular members. The inner member has an inner and an outer surface and is concentrically mounted to and is in sliding contact within the outer member for either clockwise or anticlockwise rotation therewith. The outer member has an inner and an outer surface and each member has a port. The ports are arranged to align with one another when the inner member is rotated in a first direction, to define an exit aperture adapted for cooperation with the receiver through which the material may be dispensed. The ports further are arranged to misalign with one another when the inner member is rotated in an opposed direction, to define a closed off position desirable prior to removal of the cartridge from the receiver.

BRIEF DESCRIPTION OF THE DRAWINGS

The present invention will be described further, by way of examples, with reference to the accompanying drawings in which.

DESCRIPTION OF THE PREFERRED EMBODIMENTS

Figure 1:
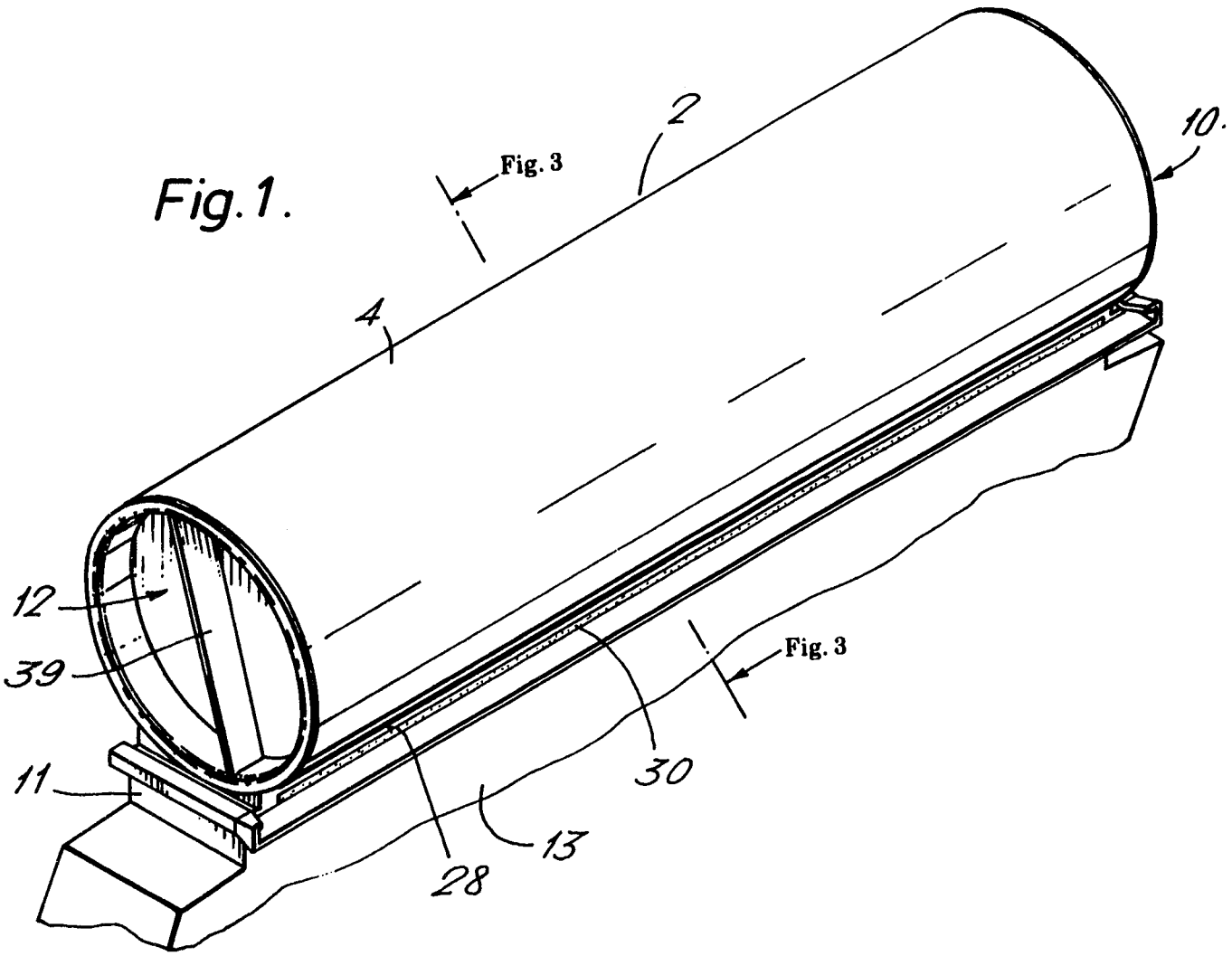
FIG. 1 is a perspective view of a cartridge in accordance with one embodiment of the invention mounted on a toner sump.
Figure 2:
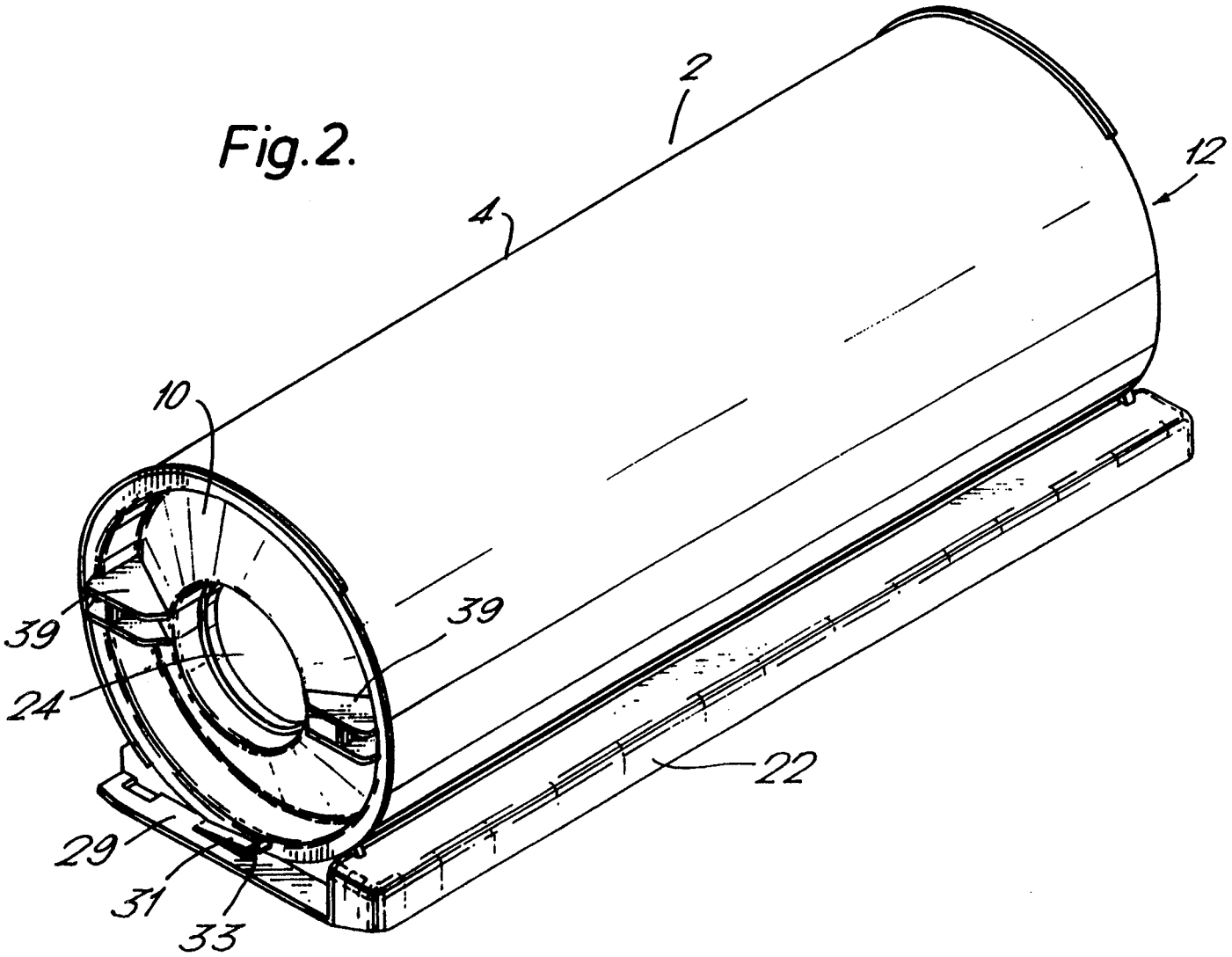
FIG. 2 is a perspective view from the opposed side of the cartridge of FIG. 1 with the toner sump omitted to show the mounting flange of the cartridge in greater detail.
Figure 3:
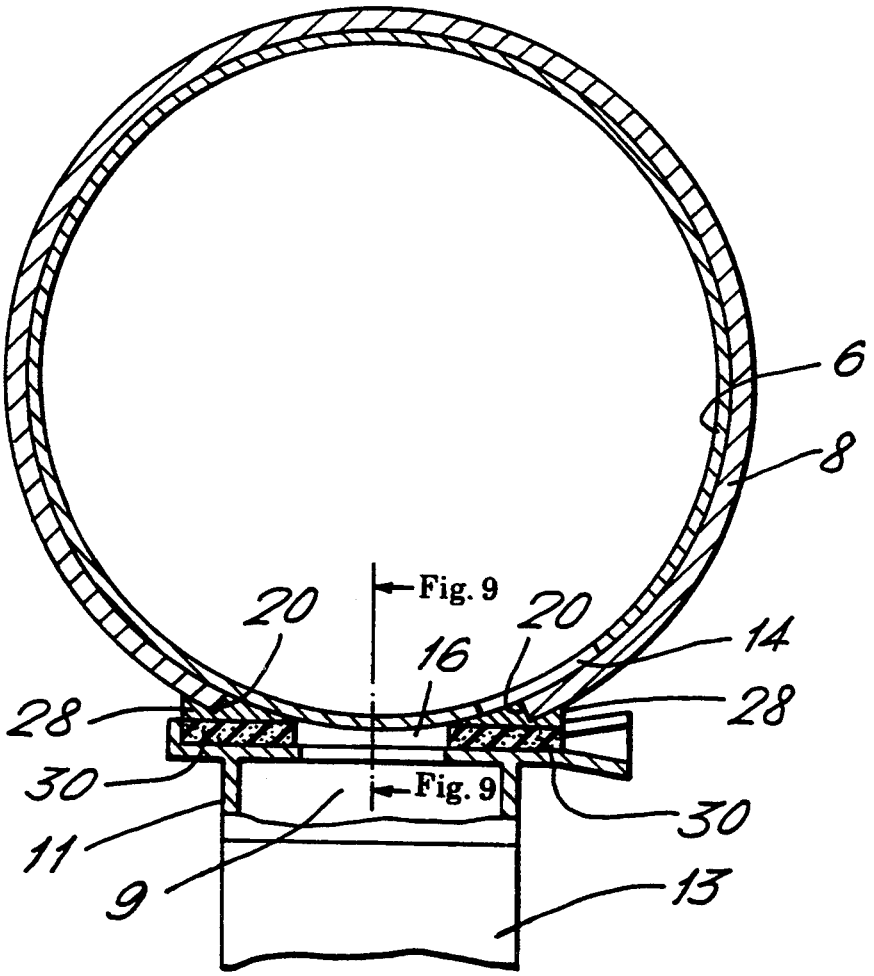
FIG. 3 is a sectional elevational view taken along the line A—A of FIG. 1 in the direction of the arrows.

Referring to FIGS. 1, 2 and 3 of the drawings, the cartridge 2 comprises a tubular housing 4 which is closed at its ends with two end caps 10, 12. The housing 4 comprises an inner plastic or cardboard tube 6 located concentrically within, and mounted for rotational movement relative to, an outer plastic or cardboard tube 8. The outer surface of the inner tube 6 is arranged for sliding contact with the inner surface of the outer tube 8. Each of the concentric tubes 6, 8 has a respective longitudinal port 14, 16, the arrangement being such that the pair of ports 14, 16 do not line up during transit. When as described below the ports 14, 16 of the tubes 6, 8 are aligned during a dispensing operation then they together define an exit aperture for the housing 4. The cartridge, after insertion into the machine, is mounted on a toner sump flange 11 so that the exit aperture lines up with the inlet port 9 of the toner sump 13.

Figure 4:
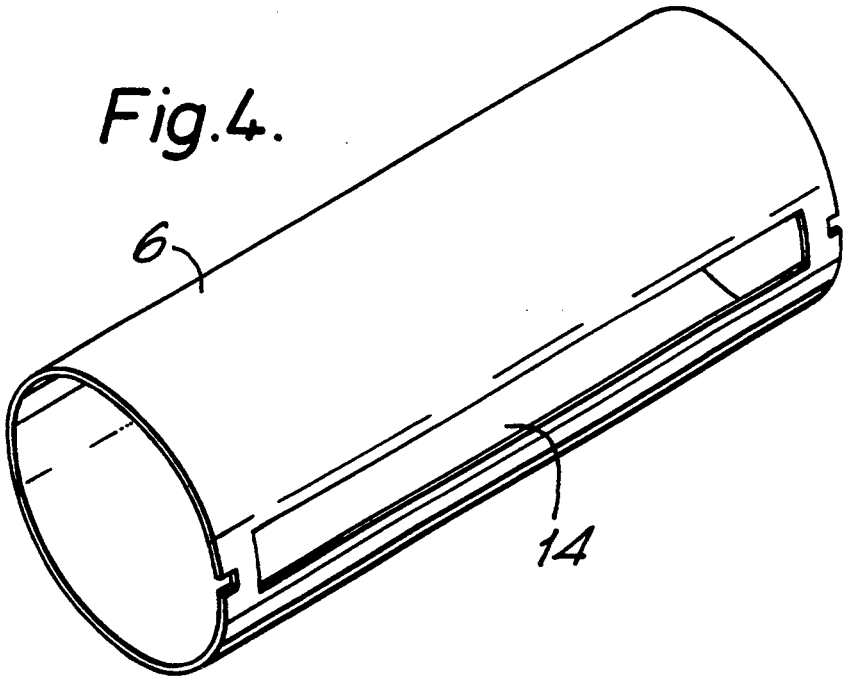
FIG. 4 is a perspective view of the inner tube of the FIG. 1 cartridge.
Figure 5:
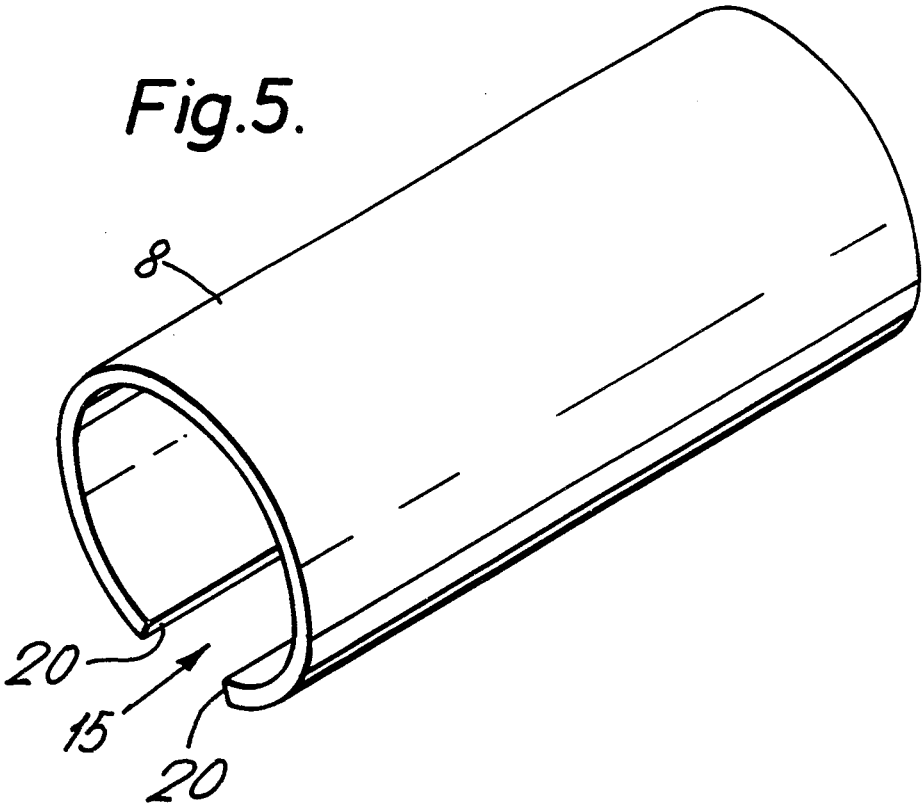
FIG. 5 is a perspective view of the outer tube of the FIG. 1 cartridge.

The inner tube 6 is shown in more detail in FIG. 4 from which it can be seen that the port 14 has a generally oblong shape the length of which is slightly less than the length of the inner tube 6. A part of the outer tube 8 is illustrated in FIG. 5 which shows a curved section of the tube cut away along its whole length leaving a gap 15 defined between longitudinal edges 20. The part is mounted on a plastic flange 22 shown in FIG. 6 which is oblong in shape and is formed with an oblong aperture through its central portion. This central aperture defines the port 16 for the outer tube 8 when the part is mounted on the flange 22.

Figure 6:
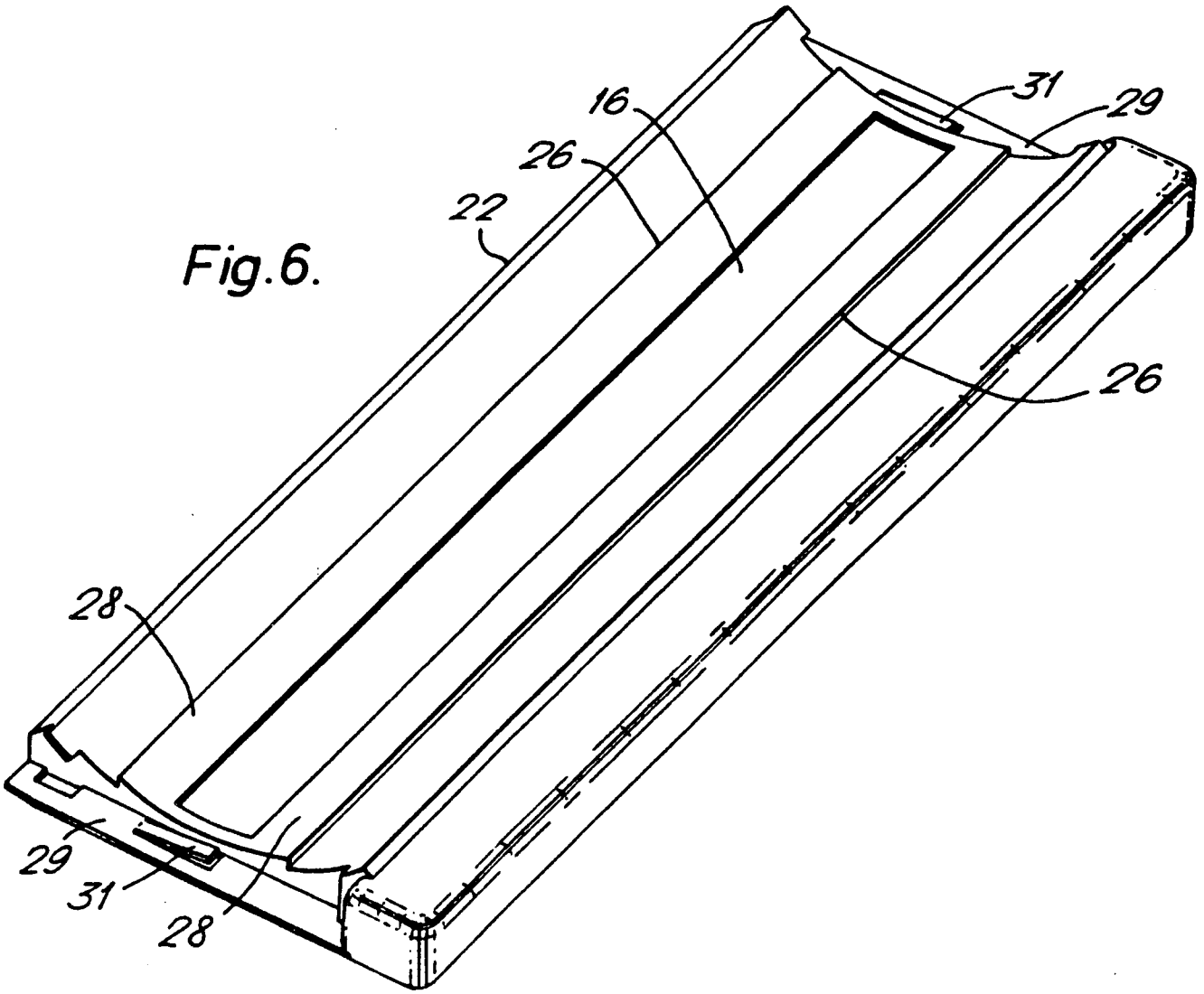
FIG. 6 is a perspective view of the FIG. 2 mounting flange.
Figure 7:
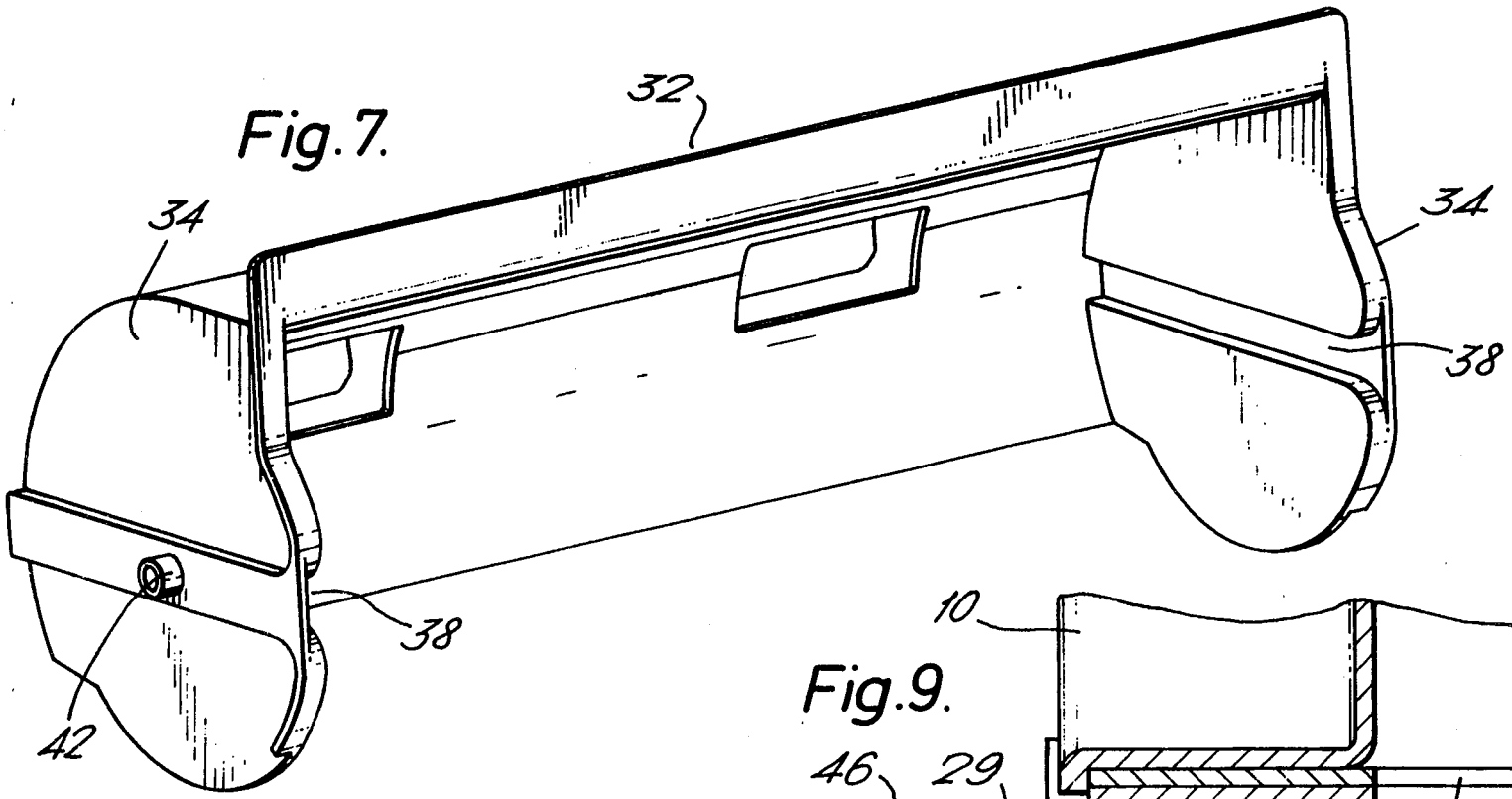
FIG. 7 is a perspective view of one embodiment of a cartridge cover.

As shown in FIG. 6, and comparing with FIG. 3, the top of the flange 22 has shaped surfaces for cooperation with the outer tube 8 so that the straight longitudinal edges 20 of the outer tube 8 engage with longitudinal edges 26 on a pair of flange portions or wedge shaped extension pieces 28. The flange portions 28 have a wedge shaped cross-section which functions in the same way as extensions on the edges 20 of the outer tube 8, partly bridging the gap 15, and extending the curved contour of the inner surface of the outer tube 8 up to the port 16. Formed at each end of the flange are a pair of flat extension portions 29 which serve as locating means for the flange in a cover 32 (see FIG. 7). Each of the portions 29 is provided with a cut out resilient plastic catch 31. The function of the catches 31 is to engage with projections 33, extending from the rim of the end caps 10, 12, to prevent rotation of the end caps. Each of the end caps 10, 12 is in a snapped engagement with the inner tubular member 6 therefore movement of the inner tubular member 6 relative to the outer tubular member is also prevented maintaining the ports of the tubular members in a closed position during transit. The flanges 22 are also each provided with a foam seal 30 beneath the wedge shaped portions 28 (see FIG. 9).

Figure 8:
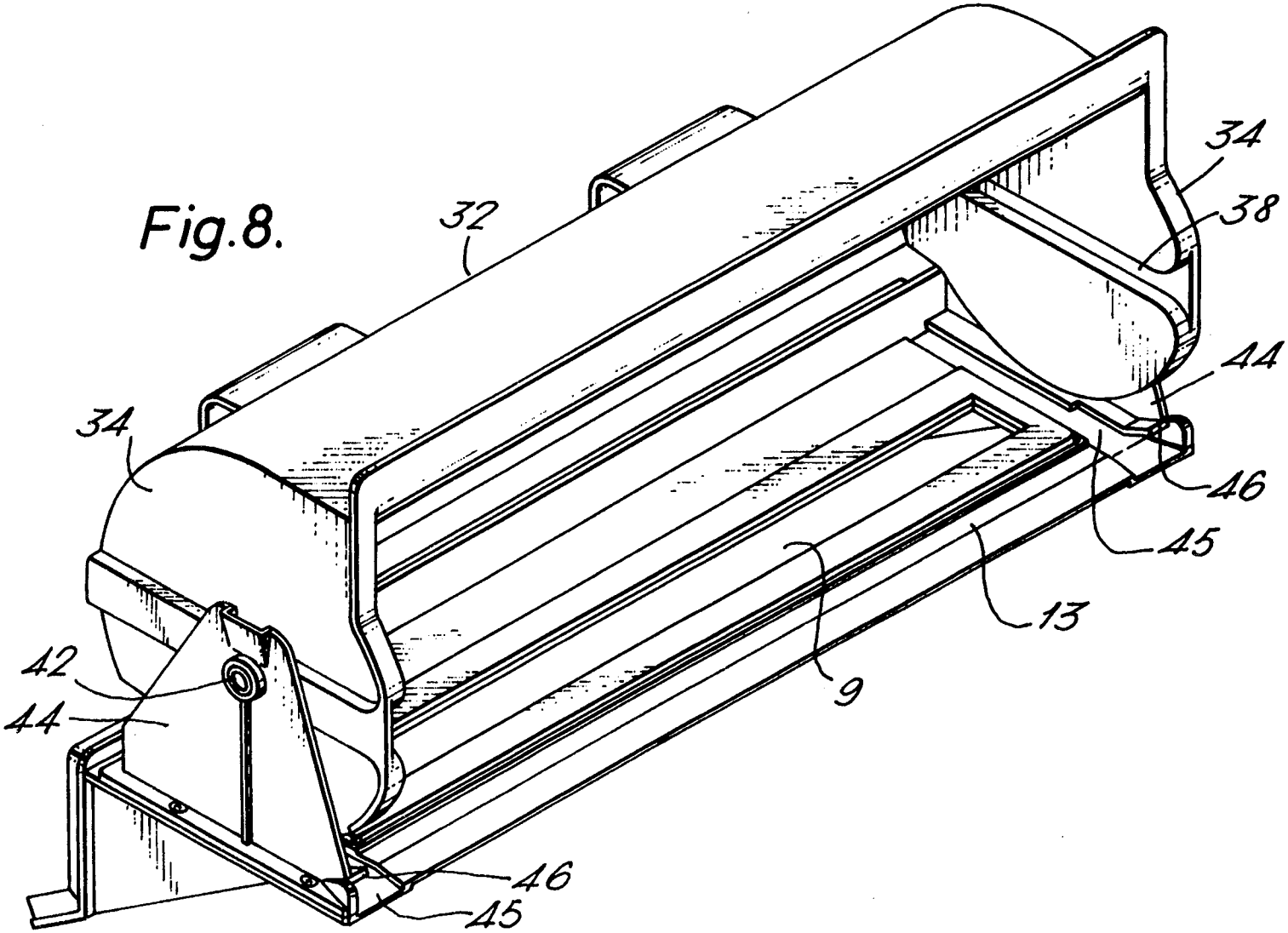
FIG. 8 is a perspective view of the FIG. 7 cartridge cover mounted between brackets above the inlet port of a toner sump.

During the assembly process the inner tube 6 is first inserted into the outer tube 8 and the outer tube 8 snapped or slid into place on the shoulders of the wedge shaped portions 28 of flange 22. The wedge shaped portions 28 provide an important function in that their narrowing to sharp edges to form the longitudinal sides of port 16 helps to keep the port 16 relatively clean of toner. The inner tube 6 is then filled with toner from a filling hole 24 which is then closed with a bung. In order to insert the cartridge unit into position over the sump 13 it is fitted into a cartridge cover :32 (see FIGS. 7 and 8). The cover 32 has two end walls 34 each of which is provided on its inner surface with a respective channel 38. The channels 38 are provided for receiving the protrusions 39 formed on the end caps 10, 12. On the outer surface of each end wall 34 is provided a respective lug 42 (only one of which is shown) for use in pivotally mounting the cover 32 between mounting brackets 44 (see FIG. 8) disposed at opposite ends of the toner sump 13. Two guide channels 45 are provided beneath brackets 46 located at the bottom of the inside walls of the mounting brackets 44, the channels 45 being provided for receiving the extension portions 29 of the flange 22 to locate and retain the flange 22, and hence retain the outer tube 8, over the sump port 9. In order to mount the cartridge into the cover 32 it is necessary to move the cartridge towards the cover 32, for example as positioned in FIG. 8, so that the protrusions 39 on the end caps slide into the channels 38 on the inside walls of the cover 32 while the extensions 29 of the flange 22 are slid into the channels 45 defined beneath the brackets 46. An outer part of the catches 31 engage the underside of the brackets 46 forcing the catches downwards thereby releasing the projections 33. Clockwise rotation of the cover 32 about its pivotal axis can therefore cause rotation of the end caps and thereby rotation of the inner tubular member 6 until the port 14 is brought into alignment with the port 16 which is itself already in place over the port 9 of the sump 13. The whole of the cartridge unit is then covered by the cover 32.

In practice it is convenient to arrange the relative positions of the ports 14, 16 during transit to be at 90° to one another so that a 90° clockwise rotation of the cover 32 is sufficient to rotate the inner tubular member 6 to a position to define the exit aperture of the cartridge which is positioned over the port 9. When all of the toner in the cartridge is dispensed then anti-clockwise rotation of the cover 32 about its pivot axis will close the ports. The cartridge can now be easily removed from the cover 32 but is usually retained until the toner level in the toner sump within the dispense housing falls below a threshold level. A toner sensor in the dispense housing detects the level of toner and provides an indication as to when a further full cartridge should be loaded into the cartridge cover 32. The dispense housing is provided with two stirrer shafts with four paddles on each shaft to assist toner flow within the dispense housing.

Figure 9:
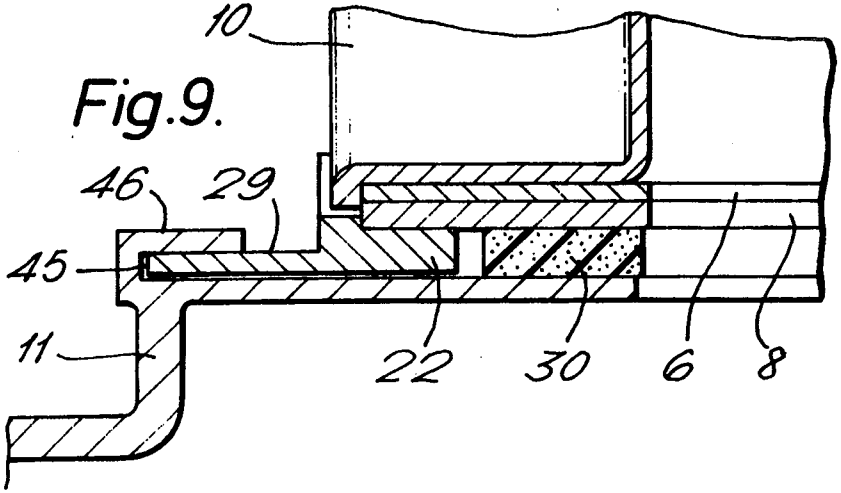
FIG. 9 is a partial sectional elevational view taken along the line Z—Z of FIG. 3 in the direction of the arrows.

FIG. 9 shows a part section Z—Z of one end of the arrangement in FIG. 3 but with the ports aligned. It can be seen how the end cap 10 is in frictional engagement with the rim, and with part of the internal surface, of the inner tube 6 so that rotation of the end cap 10 relative to the outer tube 8 causes identical relative rotation of the inner tube 6. The flange of the toner sump 11 is formed at the sides with a guide to define the channels 45 for the locating extensions 29 of the cartridge flange 22.

While the invention has been described above in connection with a preferred embodiment it is to be understood that it is not intended to limit the invention to that embodiment. On the contrary, it is intended to cover all alternatives, modifications and equivalents as may be included within the scope of the invention as defined by the appended claims. For example, in alternative embodiments the cover 32 can be dispensed with, the cartridge being placed directly with its flange over the sump port and the inner tube 6 being rotated by means of a lever (or other means) until the inner tube port 6 lines up with the outer tube port and allows the toner to drop into the developer housing through the port in the sump flange. Reverse rotation will close the ports and allow removal of the cartridge unit when required.

It will be appreciated that the embodiments of the invention provide a dispensing cartridge which is designed to avoid spillage of material, for example toner, from the cartridge both during insertion and withdrawal of the cartridge from a machine. The use of two concentrically mounted tubes with slots in them that do not line up until required obviates the need for a sealant adhesive strip over the exit aperture during transit of the cartridge and provides a cartridge design which can be inserted into a machine in any predetermined direction without spillage of the material. When it is desired to remove the cartridge one has the facility to reverse the relative rotation of the tubes so that the ports are in a closed position during removal thereby ensuring that the outer areas of the cartridge are free of material allowing clean handling.

We claim:

1. A dispensing cartridge adapted to discharge material therefrom to a receiving member during a dispensing operation comprising:

an inner tubular member having an inner surface and an outer surface, and defining an inner port therein;

an outer tubular member having an inner surface with a curved contour of constant diameter and an outer surface, and defining an outer port therein, said inner tubular member being mounted rotatably within said outer member and in sliding contact therewith; and a cover, coupled to said inner tubular member, adapted to rotate said inner tubular member in response to movement of said cover from a first position, wherein the inner port and the outer port are aligned with one another to define an exit aperture for discharging material from the cartridge to the receiving member, to a second position, wherein the inner port and the outer port are misaligned from one another to define a closed position preventing discharge of material from the cartridge, wherein said outer tubular member further comprises a substantially wedge shaped portion immediately adjacent the outer port, the wedge shaped portion having a surface to conform to the inner surface of said outer tubular member and which extends the curved contour of the inner surface, said wedge shaped portion having a sharp edge defining the outer port in said outer tubular member.

2. A dispensing cartridge as claimed in claim 1, wherein said wedge shaped portion comprises a wedge shaped extension piece attached to said outer tubular member.

3. A dispensing cartridge as claimed in claim 2 wherein said wedge shaped portion comprises a portion of wall formations of a flange on which said outer tubular member is mounted, said flange defining an aperture therethrough which together with edges of the wedge shaped portion define the outer port of said outer tubular member.

4. A dispensing cartridge adapted to discharge material therefrom to a receiving member during a dispensing operation comprising:

an inner tubular member having an inner surface and an outer surface, and defining an inner port therein;

an outer tubular member having an inner surface and an outer surface, and defining an outer port therein, said inner tubular member being mounted rotatably within said outer member and in sliding contact therewith;

a cover, coupled to said inner tubular member, adapted to rotate said inner tubular member in response to movement of said cover from a first position, wherein the inner port and the outer port are aligned with one another to define an exit aperture for discharging material from the cartridge to the receiving member, to a second position, wherein the inner port and the outer port are misaligned from one another to define a closed position preventing discharge of material from the cartridge, said outer tubular member further comprising locking means cooperating with said cover for preventing relative rotation between said inner tubular member and said outer tubular member, whereby the inner port may be retained misaligned from the outer port in the closed port position preventing escape of material from the cartridge; and wherein said locking means further comprise a receiving device including mechanical engagement means, said engagement means releasing said locking means upon insertion of said outer tubular member and said inner tubular member into said receiving device.

5. A dispensing cartridge as claimed in claim 4, wherein said receiving device defines a port aligned with the outer port of said outer tubular member.

6. A dispensing cartridge as claimed in claim 5, further comprising locating means and said receiving device comprises retention means for cooperation with said locating means for retaining said outer tubular member in a fixed position relative to the port of said receiving device while permitting the rotation of said inner tubular member.

* * * * *